United States Patent [19]

Miller et al.

[11] Patent Number: 4,676,804

[45] Date of Patent: Jun. 30, 1987

[54] COAL CLEANING BY GASEOUS CARBON DIOXIDE CONDITIONING AND FROTH FLOTATION

[75] Inventors: Jan D. Miller, Salt Lake City, Utah; Manoranjan Misra, Tuscaloosa, Ala.

[73] Assignee: University of Utah, Salt Lake City, Utah

[21] Appl. No.: 778,783

[22] Filed: Sep. 23, 1985

[51] Int. Cl.[4] ..... C10L 9/02

[52] U.S. Cl. ..... 44/1 R; 44/1 SR; 209/166

[58] Field of Search ..... 44/1 SR, 1 R; 201/17; 423/461; 209/133, 166

[56] References Cited

U.S. PATENT DOCUMENTS

| | | | |
|---|---|---|---|
| 2,142,207 | 1/1939 | Price | 209/165 |
| 3,998,604 | 12/1976 | Hinkley | 209/166 |
| 4,053,285 | 10/1977 | Robinson et al. | 44/1 SR |
| 4,288,231 | 9/1981 | Taylor | 44/1 R |
| 4,482,351 | 11/1984 | Kitazawa et al. | 44/1 R |
| 4,522,628 | 6/1985 | Savins | 44/1 SR |
| 4,613,429 | 9/1986 | Chiang et al. | 44/1 SR |

FOREIGN PATENT DOCUMENTS

| | | | |
|---|---|---|---|
| 2097423 | 11/1982 | United Kingdom | 44/1 SR |

OTHER PUBLICATIONS

Pages 63 and 75–89 of book titled Industrial Waste Flotation by Lawrence A. Roe, Roeco, Inc. (1983).

*Primary Examiner*—Carl F. Dees
*Attorney, Agent, or Firm*—Ruth Moyerman

[57] ABSTRACT

A process for froth flotation of coal using gaseous carbon dioxide includes a preconditioning treatment of the coal with gaseous carbon dioxide followed by froth flotation, preferably also using gaseous carbon dioxide. The pretreatment causes the coal to show improved results in that less reagent promoter and frother are required, and the flotation time is reduced. The process is particularly useful for producing "super" clean coal.

10 Claims, 7 Drawing Figures

FIG. 1
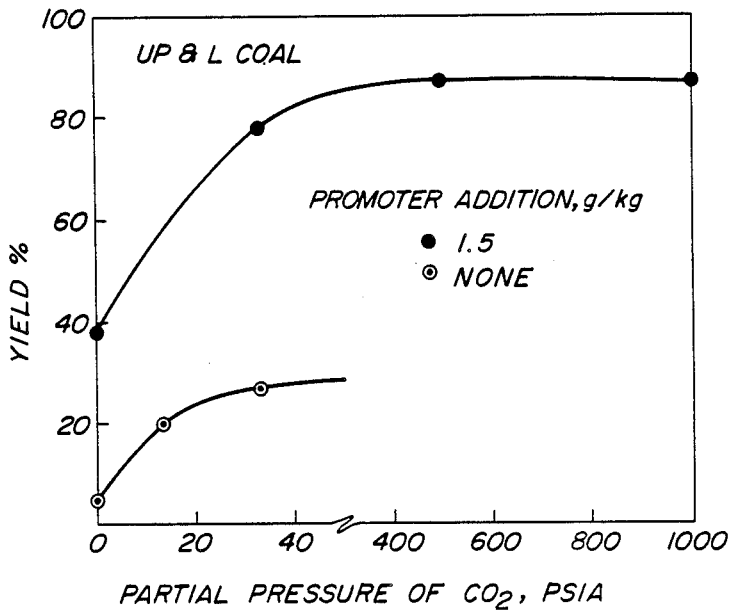
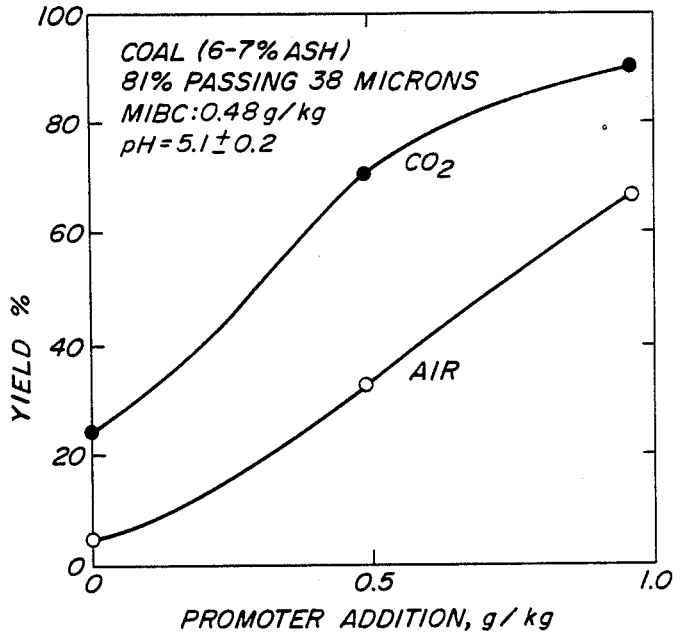
FIG. 2

FIG. 3
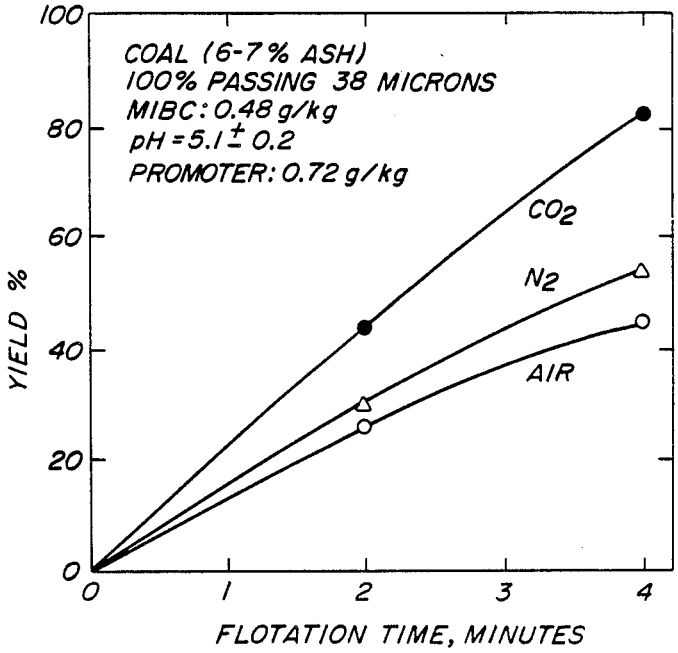
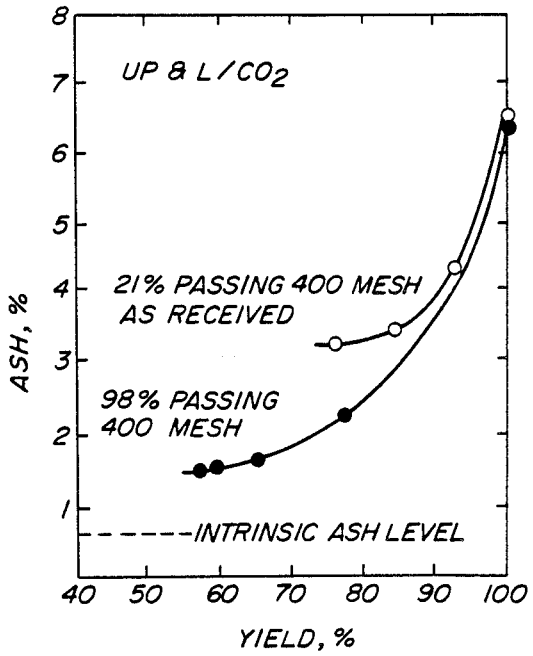
FIG. 4

COAL CLEANING BY GASEOUS CARBON DIOXIDE CONDITIONING AND FROTH FLOTATION

BACKGROUND OF THE INVENTION

1. Field of the Invention

This invention relates to coal flotation, and more particularly to coal froth flotation utilizing gaseous carbon dioxide for production of clean coal concentrates.

2. Description of the Prior Art

Froth flotation is a physicochemical separation process that depends on the attachment of air bubbles to hydrophobic particles. Other (hydrophilic) particles are wetted by the aqueous phase and will not attach to the air bubbles. Thus the separation of coal particles from gangue minerals by froth flotation occurs, for example, as dispersed air bubbles pass through a suspension of coal particles (−28 mesh). The bubble/particle aggregates of coal float to the surface and may be collected as a clean coal concentrate separated thereby from the wetted gangue particles.

Generally this process involves the use of suitable reagents (neutral molecular oils) to enhance the hydrophobic character of coal particles while the gangue mineral particles remain hydrophilic. These neutral molecular oils such as kerosene or fuel oil are called promoters and are used to enhance the attachment of air bubbles at the coal surface by forming a thin oil coating over the coal particles to be floated. Further, a frother is added to establish a stable froth phase to hold the bubble/particle aggregate. In coal flotation, frothers such as methyl isobutyl carbinol, terpinol, cresols, and polyglycols are frequently used. The choice of frother and oil depends on the desired level of selectivity with respect to ash and sulfur.

Although the foregoing known processes are successful for conventional coal flotation, it is more difficult to produce "super-clean" coal by flotation of finely ground coal (−400 mesh). The promoter which is used to increase hydrophobicity inadvertently adsorbs on the gangue minerals, and these gangue minerals subsequently migrate to the concentrate, thus decreasing the quality of the product. Also, reagent consumption is high because fine coal, due to its high surface area, adsorbs significant amounts of promoter and frother. Finally, the rate of fine coal flotation by existing flotation techniques is very slow. As a result, the production of super-clean coal by conventional froth flotation methods has had limited success.

A super-clean coal product is particularly desirable in the production of coal/water fuel. Coal/water fuel contains roughly 70% of the super-clean coal and is stabilized by the addition of various chemical additives so that it can be pumped, stored and used much like oil for which it is intended as a substitute.

In regard to the utilization of carbon dioxide in coal cleaning processes, some work has been done. For example, U.S. Pat. No. 4,522,628 to Savins discloses a method for removing ash from coal using liquid carbon dioxide under pressure in order to fracture and crush coal, not for flotation. In Savins, after comminution at high pressure and elevated temperature with liquid carbon dioxide, conventional flotation is used for coal recovery. Santhanam, in U.S. Pat. No. 4,206,610, also uses liquid carbon dioxide. The carbon dioxide is used in the Santhanam reference as a liquid to replace water as a medium to transport coal from mine to a remote processing plant. However, liquid carbon dioxide processes (transportation and cleaning) have inherent problems which relate to the chemical and physical properties of carbon dioxide (the need to keep it under positive pressure, etc.).

Other references treating coal for various purposes include U.S. Pat. No. 3,998,604 to Hinkley which discloses the use of acids for grinding of coal. Hinkley uses acid treatment (not gas) during grinding. This is a type of leaching reaction. Carbon dioxide is mentioned in passing as a companion to carbonic acid for the sole purpose of grinding and making an acid slurry. Subsequently, the ground coal is floated and whether the coal "floats" or "sinks" is dependent on the flotation reagents, not the gas used.

Steam and gaseous carbon dioxide have also been used in a high temperature coal process. Robinson et al, in U.S. Pat. No. 4,053,285, discloses a steam/carbon dioxide process for chemically treating (using hydrogen) previously prepared coal to lower the sulfur content. At high temperature and pressure, sulfur in the coal reacts with carbon dioxide and steam and is reduced to a sulfide. Flotation is not involved in this prior art reference.

No process is known which utilizes gaseous carbon dioxide to improve the hydrophobic character of the coal surface. That is, no process is known which uses gaseous carbon dioxide as a surface active reagent in the froth flotation cleaning of coal.

SUMMARY OF THE DISCLOSURE

The aforementioned prior art problems are obviated by utilizing gaseous carbon dioxide for froth flotation of coal to produce, particularly, super clean (ash free) coal concentrates. A higher rate of recovery, by a factor or two, has been demonstrated for a western, high-volatile bituminous coal. Other coal types are also amenable to the process of this invention. In this discovery, carbon dioxide is used for gas phase conditioning of a coal/water suspension which, for example, may be pressure filtration of the slurry or pressurized mixing in a stirred tank reactor, prior to flotation of the material in a flotation cell, also using carbon dioxide.

BRIEF DESCRIPTION OF THE DRAWING(S)

FIGS. 1 thru 6 are graphic representations of experimental data on various coal samples.

FIG. 1 measures yield increase for increasing partial pressure of carbon dioxide.

FIG. 2 measures yield increase for increased promoter addition and compares the response for air to that for carbon dioxide.

FIG. 3 measures yield increase for increased flotation time and compares the response for air and nitrogen to that for carbon dioxide.

FIG. 4 shows the separation efficiency in terms of ash percent in the clean coal versus yield percent for different particle size distributions.

FIG. 5 compares the separation efficiency in terms of ash percent in the clean coal versus yield percent of air pretreatment to that of carbon dioxide pretreatment for UP&L coal.

FIG. 6 compares the separation efficiency in terms of ash percent in the clean coal versus yield percent of air pretreatment to that of carbon dioxide pretreatment for Elkhorn coal.

FIG. 7 is a block diagram of the process of this invention applied to a field operation.

DETAILED DESCRIPTION OF THE PREFERRED EMBODIMENT(S)

Figure 5:
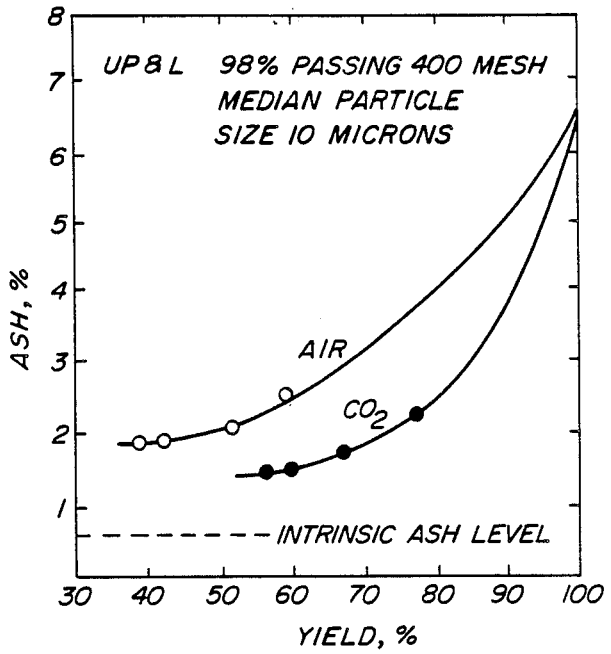

Laboratory experiments were conducted to establish the efficacy of this invention.

Flotation Experiments

Experimental results are reported for a western, high-volatile bituminous coal (UP&L) obtained from Utah Power and Light Company, Salt Lake City, Utah, containing 6–7% ash. Further details are given in Table I.

In Table I, column 1 indicates the origin of the coal sample. Column 2 indicates the ash content in percent, and column 3 the volatile matter. Column 4 represents the fixed carbon.

TABLE I

| Coal type | Ash % | Volatile Matter, % | Fixed Carbon, % |
|---|---|---|---|
| Western Coal (UP&L) | 7.67 | 47.46 | 44.87 |
| Eastern Coal (Elkhorn) | 6.38 | 35.43 | 58.19 |

The western, UP&L coal, as received, was wet ground in a conventional ball mill for a specified time at 50% solids as is well known in the art. Flotation experiments were conducted using a 2-liter, Galigher flotation machine at 8.3% solids with addition of commercial methyl isobutyl carbinol (MIBC) as a frother and a kerosene as collector as is well known in the art. Flotation products were analyzed for ash by standard thermogravimetric technique. All carbon dioxide flotation experiments were compared to air flotation experiments under the same experimental conditions (pH, temperature, and gas flowrate of 6.5 standard liters per min.).

In one series of experiments, shown in FIG. 1, batches of freshly ground coal slurry were first treated or conditioned using carbon dioxide at the indicated pressure. Conditioning in this case involved pressure filtration. The coal was then repulped in the flotation cell with carbon dioxide saturated water and floated with staged additions of promoter and frother. FIG. 1 is a plot of clean coal yield as a function carbon dioxide conditioning pressure and demonstrates the significant improvement in coal recovery by conditioning with carbon dioxide. The effect is observed both in the absence and presence of promoter. For example, with 1.5 g/kg kerosene promoter, the percent of coal recovered in the clean coal concentrate increases from 39 percent for conditioning at a low carbon dioxide pressure (0.004 psia) to almost 90 percent for conditioning at 500 psia.

In another series of experiments, UP&L coal was ground to 81 percent passing 38 microns. The flotation yield of this material for carbon dioxide pretreatment (33.4 psia) was compared to that for air pretreatment (33.4 psia) at three different levels of kerosene promoter addition. At 0.9 g/kg, the ash content of carbon dioxide treated coal was 2.3% by weight at 87.7% yield (i.e., weight percent recovered), where for air-treated coal, the ash content was 2.8% at 63.3% yield. FIG. 2 demonstrates again the improved separation that can be achieved with carbon dioxide conditioning pretreatment.

As can be seen from FIG. 3, for UP&L coal, under the experimental conditions indicated, the rate of flotation of fine coal (100% passing 38 microns) with carbon dioxide pretreatment is much faster than that with air or nitrogen. For example, with the addition of 0.48 g/kg methyl isobutyl carbinol and 0.72 g/kg of kerosene promoter, 84.0% of the coal can be recovered in the concentrate in four minutes as compared to 45.0% and 54.0% with air and nitrogen, respectively.

These results presented in FIG. 1–3 for UP&L coal show the significant improvement of clean coal yield with carbon dioxide conditioning, i.e., pretreatment.

Also of importance is the quality of the clean coal product, i.e., its ash content. In this regard, the effectiveness of the carbon dioxide flotation process was evaluated with respect to ash content of the clean coal product. In addition to bench scale flotation tests with the western UP&L coal, an eastern coal (Elkhorn) was also studied. The proximate analyses for both coal samples are given in Table I. The western coal, as received, was wet-ground in a conventional ball mill for a specified time at 50% solids. The eastern (Elkhorn) coal was crushed and pulverized to −28 mesh and then wet-ground under conditions similar to those for the western coal. The freshly ground coal slurries were filtered (at 33.4 psia) using carbon dioxide in one case and air in another case.

After filtration, the filter cake was kept under carbon dioxide gas for thirty minutes. After thirty minutes, the filter cake was repulped in the flotation cell with a saturated aqueous solution of the respective gas phase.

Flotation experiments were conducted, again using a Galigher flotation cell at a gas flowrate of 5 standard liters/min and at 900 rpm. Commercial-grade MIBC and kerosene were used as frother and promoter respectively. As before, stage additions of frother and promoter were implemented throughout the flotation experiment. The first stage of flotation was conducted for ten minutes after an initial addition of 1.5 g/kg promoter and 0.1 g/kg frother. After five minutes during the first stage flotation, an additional 0.05 g/kg frother was added to maintain the froth. In subsequent cleaning stages, 0.05 g/kg frother and 0.25 g/kg promoter were added per stage. As-received western coal was floated under similar conditions. However, in the subsequent cleaning stages only 0.05 g/kg frother was added per stage. Reagent levels depend upon the type of coal being floated.

Figure 6:
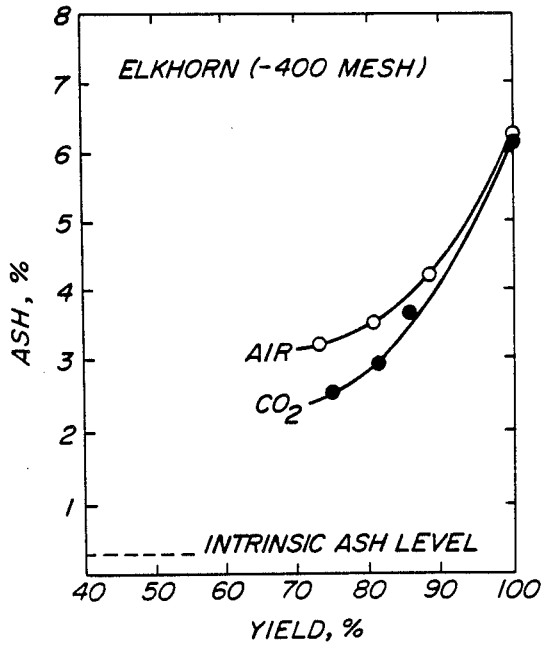

Products from the flotation experiments were analyzed, and from these data, ash/yield curves were prepared as shown in FIGS. 4 through 6. In FIGS. 4 through 6, the dotted lines indicate the intrinsic ash level which is a measurement of ultimate ash level that might be achieved in the clean coal product as determined by acid leaching. FIG. 4 refers only to UP&L coal and shows yield versus percent ash for two different particle size distributions. FIG. 4 demonstrates that, even for carbon dioxide flotation, liberation must be achieved in order to reduce the ash content of the clean coal product. Notice that an excellent clean coal product can be made containing 1.5 percent ash at a yield of at least 60 percent.

FIG. 5 refers to UP&L coal and FIG. 6 relates to Elkhorn coal. In each Figure, the percent ash was measured against yield comparing air to carbon dioxide. From these graphs it is evident that the carbon dioxide treatment provides for improved separation efficiency for both the eastern and western coal samples as evidenced by the ash content and yield. For example, in the case of UP&L coal with air pretreatment, it will be impossible to produce a clean product containing 1.5 percent ash at a yield even of 40 percent. Whereas with carbon dioxide pretreatment, such as product can be made at a yield of at least 60 percent. Similarly, in the case of the Elkhorn coal, at a yield of about 75 percent, air pretreatment will result a clean coal product containing 3.1 percent ash whereas the carbon dioxide pretreatment will result in a clean coal product containing 2.3 percent ash.

Surface Chemistry

Specific interactions of carbon dioxide at the coal surface may account for the improved separation efficiency. To test this proposition, the affinity of carbon dioxide for a coal surface was measured by bubble attachment with a contact-angle goniometer. Experimental results indicated that the equilibrium contact angles are slightly larger for carbon dioxide (45–48°) than for nitrogen and air (38–40°). More significantly, however, the bubble attachment time for carbon dioxide was decreased by a factor of five. Results of this experiment are presented in Table II.

The hydrophobic character of Midcontinent coal for different gas-phase treatments at pH 5.0±0.2 are presented below in Table II. Column 1 indicates gas phase. Column 2 indicates attachment time as measured in milliseconds. Column 3 indicates contact angles as measured in degrees.

TABLE II

| 1 GAS PHASE | 2 BUBBLE ATTACHMENT TIME, ms | 3 CONTACT ANGLES, degrees |
|---|---|---|
| Carbon Dioxide | 20 | 45–48 |
| Nitrogen | 80–90 | 35–40 |
| Air | 100–110 | 38–40 |

Thus, although the exact method by which this invention operates is not known, it is believed that the selectivity of the flotation separation is due to the specific adsorption of carbon dioxide at the coal surface which enhances its hydrophobicity as reflected by the results presented in Table II.

Figure 7:
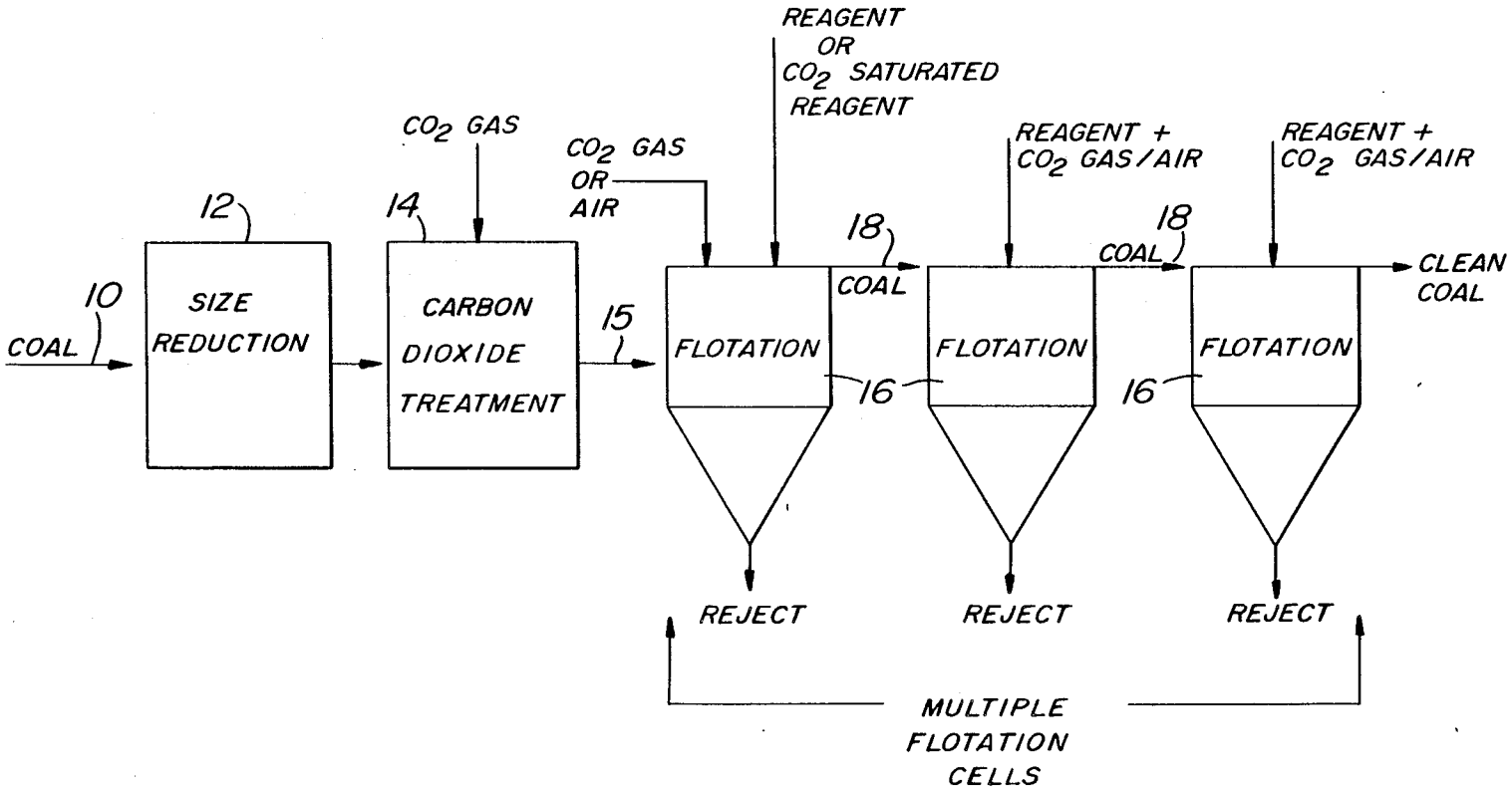

In a typical coal preparation plant utilizing the process of this invention, and with reference to FIG. 7, feed coal 10 is reduced in size by conventional methods such as wet or dry grinding as represented at 12. Size reduction, as is well known, is essential for ash reduction. Coal 10, after the size reduction step, should be less than 300 microns in size. The extent of size reduction will be dependent on the coal type and the desired level of ash. An average size of 10 to 20 microns is typically preferred for the production of super clean coal. The coal may then be slurried with water, if necessary, to the desired percent coal. A typical slurry for carbon dioxide pretreatment might be about 50 percent coal by weight.

The coal/water slurry is then passed to a pressure vessel for the carbon dioxide gas treatment or preconditioning as shown at block 14. The process can be carried out either batch wise or continuous. In a batch process, the slurry would be charged (pumped) to the vessel which would subsequently be pressurized with the carbon dioxide gas or perhaps a more economical mixture of carbon dioxide and air. In a continuous process, the slurry would be pumped to the vessel which is already pressurized. The vessel atmosphere would then be equilibrated as is known in the art. The conditioning step may be carried out in any suitable pressure vessel such as an autoclave, pressurized stirred tank or by pressure filtration. The specific pressure depends on the type of coal and must be determined by experiment as was discussed previously in reference to FIG. 1. Generally, the pressure required to achieve this effect would not exceed about 100 psia, and a pressure of about 50 psia is believed suitable. The time for the conditioning step is expected to be five to fifteen minutes, but again this time period can be refined by experiment with the particular type of coal in a manner similar to that discussed previously in regard to the experimental results.

Following conditioning, step 14, the carbon dioxide treated product is combined with additional water, if needed, shown at 15, and transferred to a flotation cell or cells as represented by 16. The slurry is preferably 5 to 10 percent coal which is established as a compromise between capacity and separation efficiency. In flotation cell(s) 16, conventional frother and collectors, indicated on the diagram as reagents, are added as needed following standard known procedures. The carbon dioxide used in the froth flotation step of this invention supplements the preconditioning step. This is, it is important for maximizing the benefits of the preconditioning step to use carbon dioxide at this step. Thus, carbon dioxide saturation, using gaseous carbon dioxide or even dry ice, may be preferred, but is not required. Air could be substituted. Also, carbon dioxide gas is also preferably added during the flotation step itself. The carbon dioxide the flotation step is used at conventional flow rates as is well known in the art. Carbon dioxide may also be used in the form of dry ice in the flotation step or be used to carbonate the flotation reagents prior to use. Clean coal shown at 18 floats and is recovered by standard methods.

There are many variations which may be practiced within the scope of this invention. The process is applicable to various grades and types of coal. For example, this process may also be used for oxidized coal.

The process of this invention has many advantages. Chiefly, this process permits an enhanced degree of coal cleaning; that is, "super" clean coal, new product with good market potential, may be produced by this method. Further, the rate at which the clean coal is produced is increased, thereby increasing the efficiency of the process. Lastly, reagent demand can be reduced.

Having now illustrated and described the invention, it is not intended that such description limit the invention, but that the invention be limited only by a reasonable interpretation of the appended claims.

What is claimed is:

1. A method of removing ash from coal as a step in a froth flotation process comprising:

(a) providing raw coal with sufficient size reduction for ash liberation;

(b) exposing said coal surface to gaseous carbon dioxide for a time and at a pressure to precondition the coal surface by enhancing the hydrophobic character of said surface by dissolving carbon dioxide into said surface;

(c) combining said carbon dioxide treated coal with water to form a slurry;

(d) adding to said slurry, frothing and promoting reagents as necessary and at least one gas selected from the group consisting of gaseous carbon dioxide, and air as a flotation gas, to float clean coal particles from ash refuse; and, (e) recovering said clean coal particles.

2. The process according to claim 1 wherein said gas of step (d) is carbon dioxide.

3. The process according to claim 1 wherein in step (c) said water is carbon dioxide saturated water.

4. The process according to claim 2 wherein said time of preconditioning is from about five to about fifteen minutes and said pressure is from about 20 to about 100 psia.

5. The process according to claim 2 wherein said raw coal average size is less than about 300 microns.

6. In a froth flotation process for the liberation of coal from refuse, the improvement comprising, prior to said froth flotation, the step of preconditioning said coal with gaseous carbon dioxide for a time and at a pressure to enhance said coal's ability to respond to said froth flotation process.

7. The process according to claim 6 wherein said preconditioning step is performed at about 20 to about 100 psia.

8. The process according to claim 7 wherein said preconditioning step is performed for about five to about fifteen minutes.

9. In a coal flotation process to improve the separation efficiency of clean coal particles from gangue minerals, the improvement comprising in combination therewith the steps of:

(a) preparing a slurry of crushed coal, which coal is of a size less than 300 microns and contains said gangue minerals, and water; and, (b) subjecting said slurry, maintained in a pressurized condition between 10 to 100 psia, to carbon dioxide gas passing therethrough.

10. A method of enhancing the hydrophobic surface properties of coal comprising:

(a) providing raw coal with sufficient size reduction for ash liberation;

(b) forming a water slurry of said coal;

(c) subjecting the coal surface to pressurized gaseous carbon dioxide for a time sufficient to enhance the hydrophobic character of said coal surface; and, (d) subjecting said surface altered coal to a froth flotation separation to produce a flotation product of enhanced coal to ash ratio.

* * * * *

UNITED STATES PATENT AND TRADEMARK OFFICE

CERTIFICATE OF CORRECTION

PATENT NO. : 4,676,804

DATED : June 30, 1987

INVENTOR(S) : Miller et al

It is certified that error appears in the above-identified patent and that said Letters Patent is hereby corrected as shown below:

Column 5, line 1, "as" should read -- a --.

Column 6, lines 26-27, insert "during" between "dioxide" and "the".

Signed and Sealed this

Twenty-second Day of December, 1987

*Attest:*

DONALD J. QUIGG

*Attesting Officer*

*Commissioner of Patents and Trademarks*